US006112447A

United States Patent [19]

Androsov

[11] Patent Number: 6,112,447

[45] Date of Patent: Sep. 5, 2000

[54] SHOTGUN CHOKE

[75] Inventor: Denis V. Androsov, Winnfield, La.

[73] Assignee: B.B.A. Research & Development, Inc, Dodson, La.

[21] Appl. No.: 09/152,227

[22] Filed: Sep. 11, 1998

[51] Int. Cl.[7] ..... F41A 21/00; F41C 27/00

[52] U.S. Cl. ..... 42/79; 89/14.6

[58] Field of Search ..... 89/14.6; 42/78, 42/79

[56] References Cited

U.S. PATENT DOCUMENTS

| | | | |
|---|---|---|---|
| 587,801 | 8/1897 | Durnford | 42/78 |
| 1,605,393 | 11/1926 | Cutts, Jr. | 89/14.3 |
| 2,442,899 | 6/1948 | McAllister | 42/79 |
| 2,589,738 | 3/1952 | Sedberry | 42/79 |
| 2,676,429 | 4/1954 | Gotterson | 42/79 |
| 2,759,286 | 8/1956 | Moore | 42/79 |
| 2,922,242 | 1/1960 | Pachmayr | 42/79 |
| 3,161,979 | 12/1964 | Lowe | 42/79 |
| 3,367,055 | 2/1968 | Powell | 42/79 |
| 3,427,648 | 2/1969 | Manning et al. | 89/14.3 |
| 3,496,667 | 2/1970 | Lowry | 42/78 |
| 3,676,947 | 7/1972 | Ashbrook | 42/79 |
| 3,724,376 | 4/1973 | Kordas et al. | 102/42 |
| 3,769,731 | 11/1973 | Pachmayr | 42/79 |
| 4,008,538 | 2/1977 | Center | 42/79 |
| 4,071,971 | 2/1978 | Tornas | 42/79 |
| 4,711,048 | 12/1987 | Ashbrook | 42/79 |
| 5,272,827 | 12/1993 | Vang et al. | 42/79 |

*Primary Examiner*—Charles T. Jordan
*Assistant Examiner*—Denis J Buckley
*Attorney, Agent, or Firm*—John M. Harrison

[57] ABSTRACT

A shotgun choke characterized by multiple, radially-arranged, longitudinal blades having blade edges of selected size and shape for contacting and scoring a wad containing the shot in a shotgun shell, causing the wad panels to open upon expulsion from the shotgun barrel and fall short of the shot string. The shotgun choke of this invention can be built integrally with or detachable from the shotgun barrel, typically by means of threads. The displacement blades constrict the wad containing the shot to effect random constriction forces on the encapsulated shot, define linear gas relief passageways and score the wad linearly to facilitate rapid opening of the wad panels upon ejection of the wad and the shot string from the shotgun choke, such that the wad does not interfere with the shot string as the latter continues to the target. Ports are provided in the shotgun choke and connect to the gas relief passageways to reduce recoil.

6 Claims, 3 Drawing Sheets

SHOTGUN CHOKE

BACKGROUND OF THE INVENTION

FIELD OF THE INVENTION

This invention relates to shotguns and more particularly, to a shotgun choke which may he integrally shaped in the barrel of a shotgun or threaded on the end of the shotgun barrel and is designed to facilitate reduced recoil and more uniform patterns. The shotgun choke of this invention is characterized by multiple, radially-oriented blades linearly arranged and selectively spaced to define a tapered choke bore and provided with blade edges of various shape, radial spacing and size. The blades score or etch the typically plastic wad containing the shot and constrict the shot in a random force distribution, as the wad and contained shot column pass through the choke segment of the shotgun choke. Scoring of the shot-containing wad before ejection from the shotgun barrel facilitates rapid opening of the wad panels before the ejected wad can interfere with the shot column or string as the shot string leaves the wad and moves toward the target. Ports provided in the choke body communicate with gas relief passageways defined by the blade and the wad to facilitate reduced recoil and the combination of reduced recoil and superior patterning of the shot facilitate greater accuracy in firing the shotgun.

The shotgun is an extremely popular firearm for use in both sport shooting, including trap, sport clays and skeet, as well as hunting. Most modern shotguns include a "choke" located at the end of the barrel for the purpose of constricting the shot column immediately before the shot exits the barrel. This constriction is effected to control the shot pattern size, shape and density and modern shotguns usually employ an interchangeable choke system, thus enabling the hunter or user of the firearm to change chokes according to shooting conditions and targets. Modern shotgun shells, loaded with steel or lead shot, employ a tubular wad typically manufactured from a plastic material, which packages the shot and separates the shot column or string from the shotgun barrel during acceleration of the wad and encapsulated shot through the gun barrel. The wad also provides initial support for the shot and protection for both the shot and gun barrel from undesirable contact with each other when the shotgun shell is fired.

One of the problems realized in patterning shotguns and obtaining a desirable shot pattern density, is that of matching a choke to a specific shotgun barrel to provide the desired patterning characteristics. The choke is the primary element which controls the size and density of the shot pattern and typically employs a tapered inner bore to constrict the shot column before it exits the barrel. While so constricted, the shot column and the shot-encapsulating wad produce a back pressure in the barrel, which causes a radial reaction force, stressing the choke. The reaction force of the shot column and the wad during constriction by the choke define the limits of the geometric parameters of the choke, thus limiting the density of the pattern which may be achieved with a specific choke design. Under circumstances where steel shot is used as compared to lead shot, the reaction force of steel is significantly greater than that of lead, further limiting safely achievable shot pattern densities.

When fired, all shotguns produce "recoil", which is the rearward propulsion of the gun resulting from high velocity escape of gases from the end of the shotgun barrel forwardly, after exiting of the shot column or string and the wad from the barrel. To reduce this recoil, many gun barrels and chokes are provided with porting, which includes an array of holes positioned perpendicular or at an angle with respect to the longitudinal axes of the choke or gun barrel. These ports or openings provide escape for a portion of the propelling gases behind the accelerating wad and encapsulated shot column, in a direction generally perpendicular to the direction of shot column travel, and serve to reduce recoil against the shooter's shoulder.

As the wad and shot column exit the gun barrel and the choke they gradually separate and the distance between the shot column and the wad, after wad and shot expulsion from the choke, greatly effects the shot pattern density. The greater the distance of travel of the shot wad, the greater the distortion of the shot column or string, since deviation of the wad from the plane of travel of the shot string while the trailing pellets in the shot string have not yet exited the wad, causes a change in the direction of travel of that number of shot which is still unseparated from the wad, thus resulting in fewer shot in a desired target area. Another negative effect which is apparent in conventional smooth bore shotgun barrels and barrel chokes is radial spinning of the wad and shot column, caused by unavoidable imperfection in the ammunition. This effect causes an increased radial dispersion of the shot as the shot column or string separates from the wad after exiting the gun barrel, effecting a decrease in shot pattern density.

Typical of the shot pattern control devices for shotguns is the choke device detailed in U.S. Pat. No. 2,922,242, dated Jan. 26, 1960, to F. A. Pachmayr, et al. The device includes a radially variable choke tube which is prefabricated as a unit independently of the tubular body of the device. U.S. Pat. No. 3,769,731, dated Nov. 6, 1973, also to Pachmayr, details an anti-fouling shot pattern control device. The device includes an outer apertured cage mounted by an adaptor to the gun muzzle and containing a shot-passing tube spaced from the muzzle and adaptor to provide a gas release gap. Also included is an apertured interceptor serving to prevent or minimize entry of shell wad debris into the outer cage apertures. U.S. Pat. No. 3,367,055, dated Feb. 6, 1968, to E. B. Powell, details a shotgun muzzle device including a compensator and a choke. The device includes an outer tubular cage containing a removable choke tube connected to the forward end of the cage and projecting rearwardly in alignment with the gun barrel. The choke tube includes apertures through which gases are discharged and first tapers to a reduced diameter and then has a straight cylindrical portion continuing forwardly at the reduced diameter. U.S. Pat. No. 3,496,667, dated Feb. 24, 1970, to E. D. Lowery, details a "Choked Shotgun With Rifled Barrel". The improved barrel includes a full choke at its muzzle end and rifling having a specified rate of twist. U.S. Pat. No. 3,676,947, dated Jul. 18, 1972, to Ashbrook, et al, details a "Muzzle Choke" in which the forward section or diverter is provided with multiple, internally-axially extending ridges that define a wall for guiding the projectiles into relative orientation to one another. The ridges define multiple walls to establish the pattern of projectiles on a target. U.S. Pat. No. 4,071,971, dated Feb. 7, 1978, to Tornas details a "Device For Increasing and Standardizing the Scatter of Shotguns, Particularly For Skeet Shooting". The device includes a barrel having grooves with small angles with respect to the longitudinal axis of the barrel. The groove portion of the muzzle is constricted to provide a converging and then diverging wall portion and the roots of the groove define a cylinder having a diameter comparable to the diameter of the barrel. The width of the grooves is greater than the size of the shot and discharge of the shot through the barrel past the grooves produces a twisting movement which provides a uniform distribution of shot. U.S. Pat. No. 4,711,048, dated Dec. 8, 1987, to Ashbrook, details an "Anti-personnel Shotgun Choke". The shotgun choke is designed to deform the shot pattern and throw a wide pattern with a narrow vertical band, by maintaining a substantially constant width in the choke but narrowing the height of the interior of the choke in a parabolic fashion.

It is an object of this invention to provide a built-in or interchangeable shotgun choke which is characterized by multiple, radially-disposed and selectively spaced blades having blade edges of selected shape for scoring or etching the shot wad and facilitating rapid opening of the wad panels upon expulsion of the wad and the shot column or string from the shotgun to decrease interference of the wad with the shot string.

Another object of this invention is to provide a shotgun choke which is characterized by multiple, linearly-disposed, radially-oriented blades provided in the shotgun choke bore, which blades create a bore taper and define gas relief passageways communicating with multiple ports for reducing recoil, and blade edges of selected shape and size for engaging and linearly scoring the wad from a shotgun shell and promoting random constriction forces on the encapsulated shot and rapid opening of the wad panels upon expulsion of the wad from the shotgun choke and substantially undistorted exit of a shot pattern from the wad to the target.

Still another object of this invention is to provide a shotgun choke for removable mounting on a shotgun by means of threads, which shotgun choke includes a tapered bore segment fitted with radially-disposed, linearly-oriented, parallel blades having blade edges of selected shape and size. The blades define gas relief passageways communicating with multiple ports to vent expansion gases behind the shell wad and reduce recoil. Blade edges defined by the blades engage and linearly score or etch the wad to create longitudinal wad panel striations and facilitate rapid opening of the wad panels upon expulsion of the wad from the shotgun choke and release of the shot string, wherein the shot string is not distorted by the wad as the former travels to the target.

Still another object of this invention is to provide a new and improved shotgun choke tor integral or removable deployment on the end of a shotgun barrel, which shotgun choke is fitted with a mount segment typically having threads for engaging corresponding threads on the shotgun barrel and a tapered choke segment, the bore of which is coextensive with the bore of the mount segment. Ports may be provided in the choke segment and communicate with linear gas relief passageways defined by the shell wad and linearly-disposed, radially-oriented, parallel blades for venting expanding gases behind the wad along the blades. The blades have blade edges of selected size and shape for engaging and scoring the typically plastic wad and creating longitudinal striations in the wad panels, thus facilitating rapid opening of the wad panels upon expulsion of the wad and the shot string from the shotgun choke, to minimize contact between the shot and wad and promote undistorted exit of the shot column or string from the wad to the target with improved impact.

SUMMARY OF THE INVENTION

These and other objects are provided in a new and improved shotgun choke for built-in, integral placement or threadable attachment to the end of a shotgun barrel, which shotgun choke is characterized by a cylindrical choke body having a mount segment coextensive with or having threads for threadable attachment to the shotgun barrel, and a choke segment extending from the mount segment. The choke segment is fitted with multiple, linearly-disposed, radially-oriented, parallel and selectively spaced blades extending into the choke segment bore to define a bore taper at the mount segment-choke segment interface. The blades each have a blade edge or surface for linearly scoring the shot wad as the wad traverses the shotgun choke. This choke design facilitates striations in the wad panels and rapid opening of the wad panels in the shot wad upon expulsion of the shot wad and shot from the choke and exiting of the shot wad from the plane of the shot string with minimal contact with the shot, to produce a shot pattern of superior density and impact. Multiple ports may be provided in the choke segment for communication with gas relief passageways defined by the blades and the wad, to vent expansion gases driving the wad, and thus reduce recoil.

The invention will be better understood by reference to the accompanying drawings, wherein.

DESCRIPTION OF THE PREFERRED EMBODIMENTS

Figure 1:
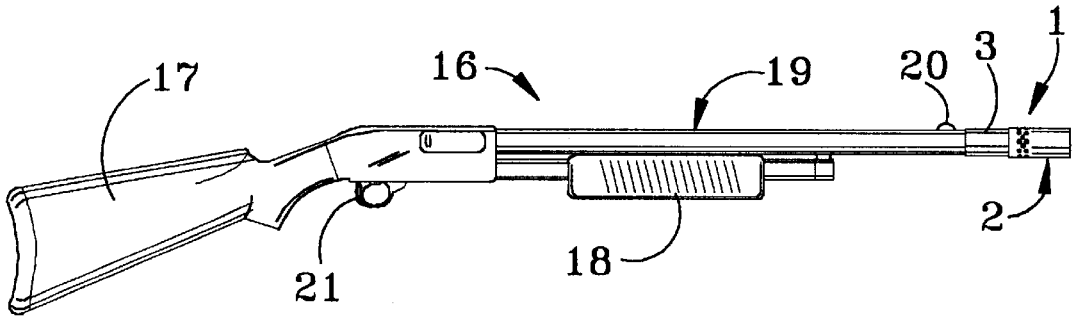
FIG. 1 is a side view of a shotgun with an unported embodiment of the shotgun choke of this invention thereon.
Figure 2:
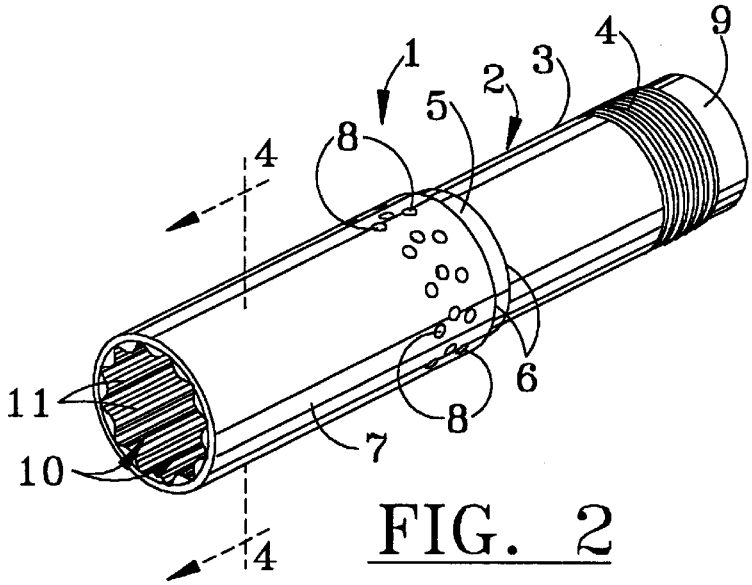
FIG. 2 is a perspective view of the shotgun choke illustrated in FIG. 1, wherein the choke segment is fitted with ports.
Figure 7:
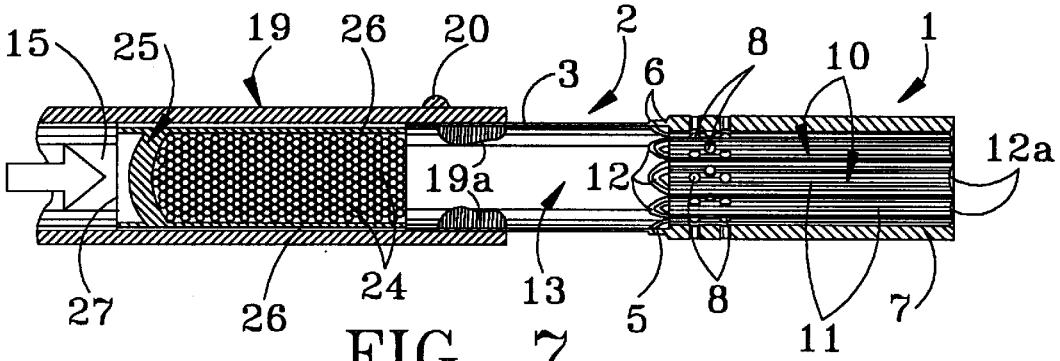
FIG. 7 is a sectional view of the shotgun choke illustrated in FIGS. 1 and 2, more particularly illustrating movement of a shotgun shell wad linearly through the barrel of the shotgun and entering the shotgun choke with shot contained in the wad.

Referring initially to FIGS. 1–3 and 7 of the drawings, the shotgun choke of this invention is generally illustrated by reference numeral 1 and is typically threaded on the end of the barrel 19 of a shotgun 16 having a stock 17, a grip 18 and a trigger 21, by means of mount segment threads 4, provided on the mount segment 3 of the choke body 2 of the shotgun choke 1, as illustrated in FIG. 2. Alternatively, it will be appreciated by those skilled in the art that the mount segment 3 of the choke body 2 can be integrally formed and built-in with the barrel 19 of the shotgun 16, as desired. Accordingly, as illustrated in FIG. 7, the exterior mount segment threads 4 on the mount segment 3 of the choke body 2 typically engage corresponding interior barrel threads 19*a* of the barrel 19, to removably secure the shotgun choke 1 on the barrel 19 of the shotgun 16. An unthreaded segment ring 9, extending from the barrel threads 19*a*, typically seats in a corresponding recess (not illustrated) in the barrel 19. As further illustrated in FIG. 1 the unported shotgun choke 1 is typically attached to or extends integrally from the barrel 19 immediately forwardly of the front sight 20, to facilitate accurately sighting the shotgun 16 without interference by the shotgun choke 1.

Figure 3:
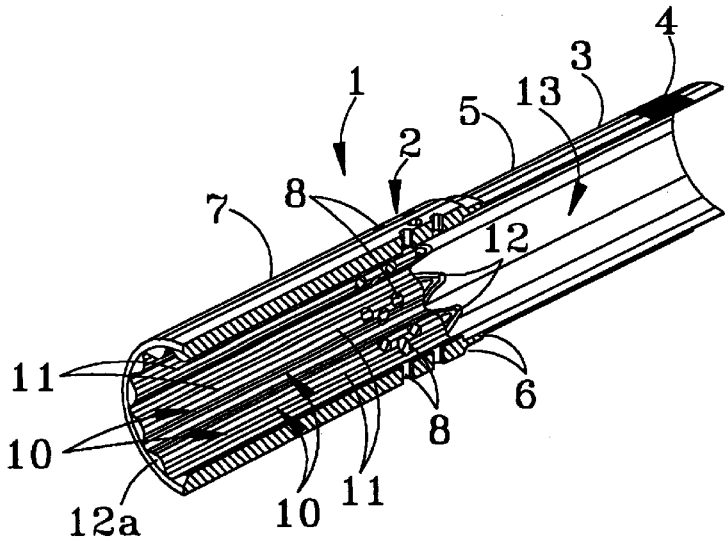
FIG. 3 is a longitudinal sectional view of the choke segment and a portion of the mount segment of the shotgun choke illustrated in FIG. 2, more particularly illustrating multiple, linearly-disposed, radially-oriented blades having blade edges extending radially into the choke segment bore.
Figure 4:
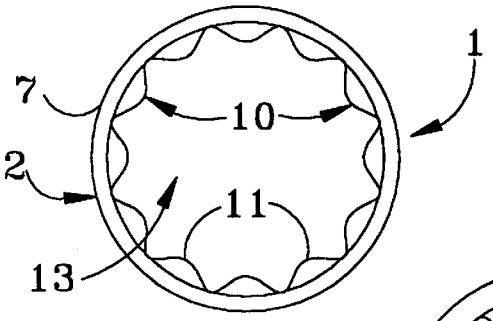
FIG. 4 is a sectional view taken along line 4—4 of the shotgun choke illustrated in FIG. 2.

As illustrated in FIGS. 2–4 of the drawings, in a first preferred embodiment of the invention the ported shotgun choke 1 is characterized by a choke segment 7, extending from the mount segment 3 of the choke body 2, which choke segment 7 is fitted with multiple ports 8 that communicate between the choke body bore 13 at the choke segment 7 and the exterior of the shotgun choke 1. A taper is typically built into the internal bore of the choke segment 7 by means of longitudinal, radially-oriented, parallel blades 10, at the blade bases 12 internally of an external body step 5 provided in the choke body 2, which body step 5 is characterized by step shoulders 6. The internal taper of the choke segment 7 is thus effected by the linearly-disposed, radially-arranged blades 10, adjacent ones of which join at blade edges 11, which are typically shaped in the configuration illustrated in FIGS. 3 and 4. As further illustrated in FIG. 3, the optional ports 8 extend through the respective blades 10, and the blade base 12 of each of the blades 10 is tapered or feathered into the inside cylindrical surface of the mount segment 3 of the choke body 2, as illustrated in FIG. 3. The opposite blade ends 12*a* of the respective blades 10 terminate essentially at or near the front edge of the shotgun choke 1 and the blade edges 11 of the respective blades 10 are slightly rounded, as further illustrated in FIG. 4.

Figure 5:
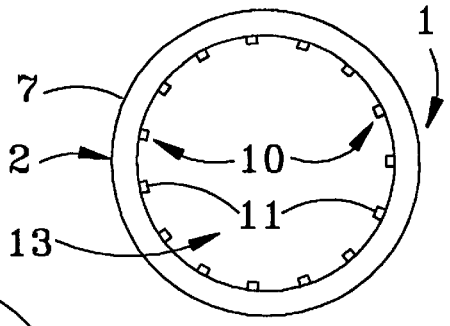
FIG. 5 is a sectional view of the shotgun choke illustrated in FIG. 2, more particularly illustrating an alternative blade configuration.
Figure 6:
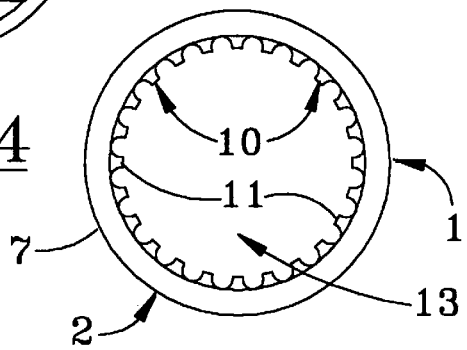
FIG. 6 is a sectional view of the shotgun choke illustrated in FIG. 2, illustrating a still further alternative blade embodiment.

Referring now to FIG. 5 of the drawings, in an alternative preferred embodiment of the invention the blade tips or edges 11 of the selectively spaced-apart blades 10 are shaped to define a flat surface which extends into the choke body bore 13 of the choke segment 7 to facilitate a more pronounced scoring of the wad traversing the shotgun choke 1. FIG. 6 illustrates a still further alternative embodiment of the blades 10 and blade edges 11, wherein the shoulders of the blades 10 extending to the blade tips or edges 11 are slightly curved to define a second alternative scoring of the wad by the blades 10 in the shotgun choke 1.

Referring to FIGS. 1, 4 and 7–10 of the drawings, and initially to FIG. 7, when the shotgun 16 in FIG. 1 is fired, the primer in the conventional shotgun shell (not illustrated) ignites a powder charge that creates expanding gases 15 behind the wad 25 at the wad base 27 (indicated by the arrow), which wad 25 contains the shot 24. Accordingly, the wad 25 and the enclosed shot 24 are propelled through the barrel 19 of the shotgun 16 in the direction of the arrow as illustrated in FIG. 7. As further illustrated in FIGS. 8 and 9, the wad 25 and encapsulated shot 24 are caused to pass through the mount segment 3 and choke segment 7 of the shotgun choke 1 and the respective wad panels 26 begin to open to release the shot 24 in a shot column or string 23 as the wad 25 begins to exit the shotgun choke 1. This rapid opening of the wad panels 26 in the wad 25 as the wad 25 extends from the end of the shotgun choke 1 is facilitated by the longitudinal or etching scoring action of the respective blade edges 11 of the blades 10 as illustrated in FIG. 11, to create the longitudinal striations 22, illustrated in FIG. 9. This scoring action and resulting striations 22 facilitates rapid curling of the wad panels 26 rearwardly as the wad 25 exits the choke segment 7 and allows the shot 24 to exit in a shot column or stream 23 which is undistorted by the slowed forward movement of the wad 25, unlike the shot column in conventional shotgun choke designs. Referring again to FIG. 9 of the drawings, because of th is rapid opening of the wad panels 26, the wad 25 rapidly drops a way from the shot string path 23*a* of the shot string 23 due to air pressure, before it can contact any of the trailing shot 24, such that the shot string 23 is substantially undisturbed in its trajectory along the shot string path 23*a* to a target (not illustrated).

Figure 10:
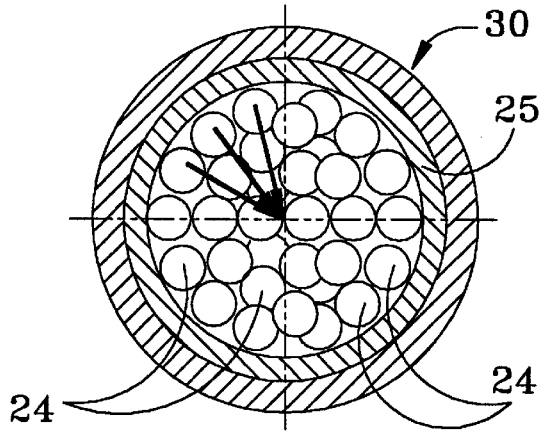
FIG. 10 is a sectional view of a conventional choke with a wad in place as the wad moves through the choke.
Figure 11:
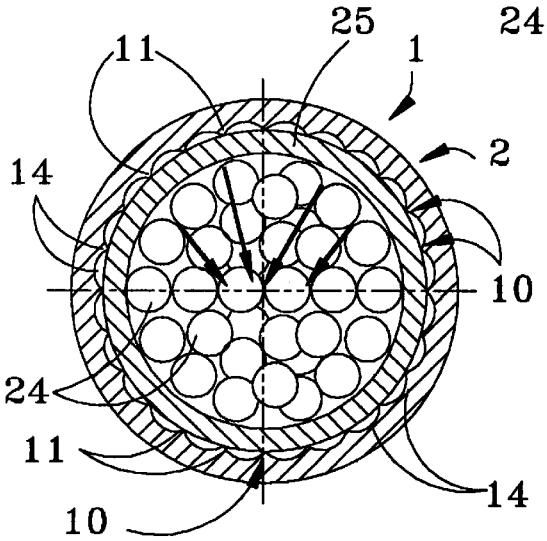
FIG. 11 is a sectional view of the shotgun choke illustrated in FIG. 2, more particularly illustrating longitudinal gas relief passageways defined by the wad and the blades for venting expanding gas behind the wad.

It will be appreciated from a consideration of FIGS. 10 and 11 of the drawings that the shotgun choke 1 of this invention (FIG. 11) applies constricting forces to the shot 24 in the shot string 23 while the shot 24 is encapsulated in the wad 25, which forces are less conducive to distorted patterns than the forces illustrated in the conventional choke 30 shown in FIG. 10. The reaction force against each shot pellet in the shot 24 extending from the center of the pellet, is perpendicular to a theoretical line which is tangent to the point of contact between the shot pellet and the interior cylindrical surface of the wad 25, as illustrated in FIG. 10. Accordingly, all constricting force vectors extend toward the longitudinal centerline of the choke body bore 13, causing relatively great radial interference between individual shot pellets in the shot 24 as the shot column or string 23 exits the shotgun choke 1. In contrast, the vectors of the constricting forces of the shot pellets illustrated in FIG. 11 extend randomly due to the pressure exerted on the wad 25 by the radially-spaced blades 10 and do not all coordinate or converge at the longitudinal centerline of the choke body bore 13, as illustrated. This random constriction or force distribution in the shot 24 illustrated in FIG. 11 provides a more optimum shot distribution in the shot string 23 and causes fewer distorted or "blown" patterns with greater shot impact at the target. Moreover, as further illustrated in FIG. 10 the outer surface of the wad 25, when passing through the conventional choke 30, follows the contour of the choke taper, which is circular in cross-sectional configuration. In contrast, the wad 25 and the contained shot 24 do not closely match the contour of the choke inner surface, but leave parallel gap areas or gas relief passageways 14, between the blades 11, as indicated in the FIG. 11. Accordingly, as the wad 25 passes through the choke segment 7 of the choke body 2 and is constricted by the parallel, radially-disposed blade edges 11 of the blades 10, a portion of the propelling gases escapes through the gas relief passageways 14, around the wad 25 and extends through the ports 8, thus reducing recoil of the shotgun 16.

Figure 8:
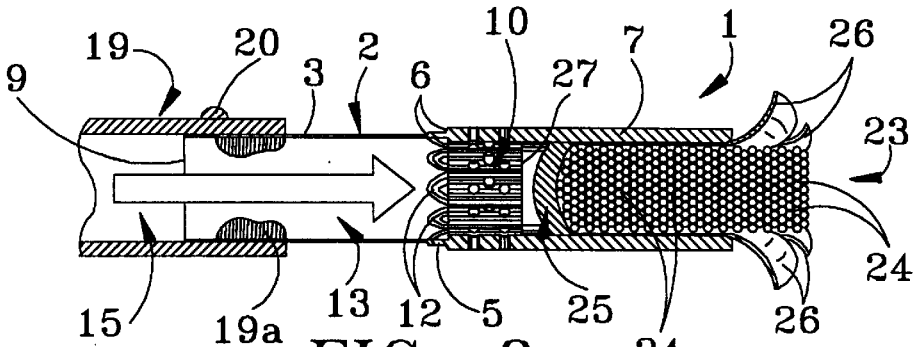
FIG. 8 is a sectional view of the shotgun choke illustrated in FIG. 7, more particularly illustrating the wad moving through the choke segment of the shotgun choke, wherein the wad is scored or etched by the internal blade edges of the blades and the projecting wad panels are beginning to open to release the shot column.
Figure 9:
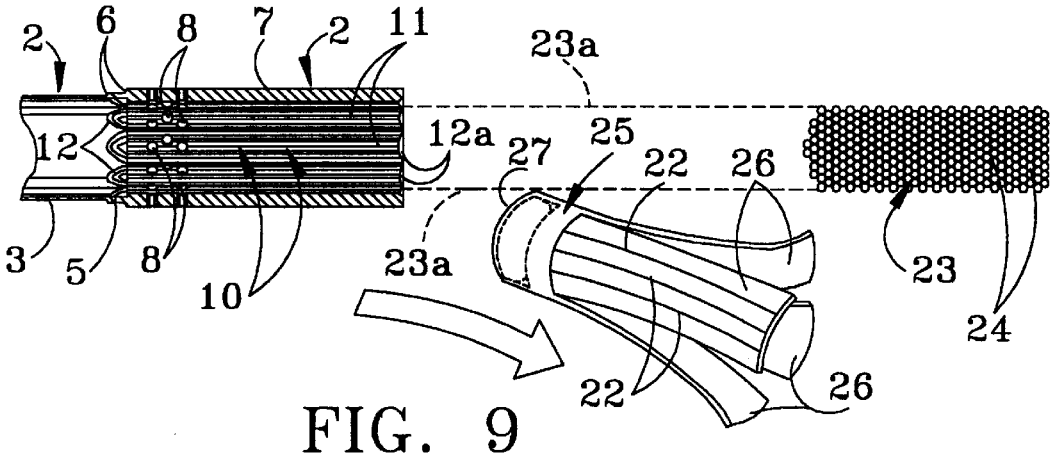
FIG. 9 is a sectional view of the choke segment of the shotgun choke illustrated in FIGS. 7 and 8, more particularly illustrating full opening of the wad panels of the wad, deflection of the wad from the plane or trajectory of the shot and ejection of the shot column or string from the wad without distortion of the shot string.

As further illustrated in FIGS. 7, 8 and 9 of the drawings, the internal taper of the choke body 2 from the mount segment 3 to the choke segment 7 can be varied by the design of the blades 10, depending upon whether shotgun shells which contain lead or steel shot are fired in the shotgun 16. As a general principal, the longer the internal taper of choice, the denser the pattern of the shot string exiting the shotgun choke. Under circumstances where shells containing steel shot are fired in the shotgun 16, the length of the taper is restricted, compared to the use of soft metal such as lead shot, due to the danger of shot penetration through the wad 25, resulting in damage to the inside surface of the shotgun choke 1.

It will be appreciated by those skilled in the art that the shotgun choke of this invention is characterized by simplicity and optimum performance, whether using shotgun shells containing steel or soft metal such as lead shot, to produce high density, high impact, unblown patterns. The shotgun choke described herein also facilitates less recoil than is possible in conventional shotgun chokes and is characterized by an internal tapered blade design that facilitates optimum random compression of the shot in the wad and yet prevents the shot from abrading through the wad and damaging the internal choke bore.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A shotgun choke for controlling a shot string and a wad ejected from a shotgun barrel, said choke comprising an elongated choke body provided on the shotgun barrel, said choke body having a longitudinal bore having a substantially circular cross-section and uniform diameter throughout the length of said bore; a plurality of ports provided in said choke body for expelling gases from the shotgun barrel; a plurality of longitudinally-disposed, substantially parallel blades provided in said bore of said choke body; a plurality of gas relief passageways defined by said blades and the wad, said gas relief passageways communicating with said ports for channeling the gases through said gas relief passageways to said ports, said blades each comprising an elongated blade base provided in said choke body and a blade edge extending from said blade base into said bore for engaging and scoring the wad and wherein said gas relief passageways are defined by said blade edge and the wad for scoring the wad and causing the wad to fall away from the shot string when the wad and shot string are ejected from the shotgun barrel and choke.

2. The shotgun choke of claim 1 wherein said choke body is characterized by a mount segment extending from the shotgun barrel and a choke segment extending from said mount segment and wherein said longitudinal bore is coextensive with said mount segment and said choke segment and said blades are disposed in said choke segment and said blades extend into that portion of said bore extending through said choke segment.

3. The shotgun choke of claim 2 wherein said plurality of ports is provided in said choke segment of said choke body.

4. The shotgun choke of claim 2 wherein said blade base is provided in said choke segment of said choke body.

5. The shotgun choke of claim 4 wherein said plurality of ports is provided in said choke segment of said choke body.

6. A shotgun choke for increasing the density of shot packed in the wad panels of a wad of a shotgun shell as the wad and shot are fired from the barrel of a shotgun, said choke comprising an elongated mount segment threadably attached to the barrel; a choke segment extending from said mount segment; a bore coextensive with said mount segment and said choke segment, said bore having a substantially circular cross-section and uniform bore diameter throughout the length of said bore; a plurality of blades longitudinally disposed in said choke segment in spaced-apart, radially-disposed, substantially parallel relationship with respect to each other for extending into said bore and engaging and scoring the wad panels containing the shot as the wad and encapsulated shot traverse said bore and causing the wad panels to open and the wad to fall short of the shot as the wad and shot are ejected from the choke; and a plurality of ports provided in said choke segment of said choke body for expelling gases from the shotgun barrel and a plurality of gas relief passageways defined by said blades and the wad, said gas relief passageways communicating with said ports for channeling the gases through said gas relief passageways to said ports.

* * * * *